US007489287B2

(12) United States Patent
Choi

(10) Patent No.: US 7,489,287 B2
(45) Date of Patent: Feb. 10, 2009

(54) METHOD AND APPARATUS FOR RESETTING A PLASMA DISPLAY PANEL

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 613 days.

(21) Appl. No.: 10/863,344

(22) Filed: Jun. 9, 2004

(65) Prior Publication Data

US 2004/0252081 A1 Dec. 16, 2004

(30) Foreign Application Priority Data

Jun. 10, 2003 (KR) ..... 10-2003-0037072

(51) Int. Cl.
*G09G 3/28* (2006.01)

(52) U.S. Cl. ..... 345/60; 345/67; 315/169.1

(58) Field of Classification Search ..... 345/60–68; 315/169.1–169.4

See application file for complete search history.

(56) References Cited

U.S. PATENT DOCUMENTS 6,320,560 B1 * 11/2001 Sasaki et al. ..... 345/60
6,476,781 B1 * 11/2002 Suzuki et al. ..... 345/60
6,633,268 B2 * 10/2003 Kougami et al. ..... 345/60
7,173,578 B2 * 2/2007 Kim et al. ..... 345/60
2002/0135545 A1 * 9/2002 Akiba ..... 345/60
2003/0189534 A1 * 10/2003 Myoung et al. ..... 345/67

FOREIGN PATENT DOCUMENTS

KR 10-2002-0092486 12/2002
KR 10-2003-0022948 3/2003
KR 10-2004-0041770 5/2004

OTHER PUBLICATIONS

Korean Office Action dated Jan. 27, 2005.

* cited by examiner

*Primary Examiner*—Richard Hjerpe
*Assistant Examiner*—Kimnhung Nguyen
(74) *Attorney, Agent, or Firm*—Ked & Associates LLP

(57) ABSTRACT

The present invention relates to a method for resetting a plasma display panel which can improve contrast by reducing unnecessary light in a set-up period, and apparatus thereof. The method for resetting the plasma display panel, includes the steps of: forming initial wall charges in the discharge cells by means of a reset discharge in a set-up period; and erasing unnecessary wall charges of the initial wall charges from the discharge cells by means of an erasing discharge in a set-down period, wherein a period where the sustain electrodes are floated during the set-up period is set in one or more sub-fields.

24 Claims, 3 Drawing Sheets

METHOD AND APPARATUS FOR RESETTING A PLASMA DISPLAY PANEL

This Nonprovisional application claims priority under 35 U.S.C. § 119(a) on Patent Application No. 10-2003-0037072 filed in Korea on Jun. 10, 2003, the entire contents of which are hereby incorporated by reference.

BACKGROUND OF THE INVENTION

1. Field of the Invention

The present invention relates to a plasma display panel, and more particularly, to a method for resetting a plasma display panel which can improve contrast, and apparatus thereof.

2. Description of the Background Art

Recently, a plasma display panel (hereinafter, referred to as "PDP") that can be easily fabricated as a large-scale panel has attracted public attention as a flat panel display device. The PDP is adapted to display an image by controlling a gas discharge period of each of pixels according to digital video data. FIG. 1 is a perspective view showing the structure of a discharge cell in a conventional plasma display panel. A representative PDP is one having a three-electrode and driven as an AC voltage, as shown in FIG. 1.

A discharge cell of an AC type PDP shown in FIG. 1 includes a pair of sustain electrodes 12A and 12B formed on the bottom of an upper substrate 10, and a data electrodes 20 formed on the top of a lower substrate 18.

Each of the pair of the sustain electrodes 12A and 12B includes a dual layer structure of a transparent electrode and a metal electrode. These pair of the sustain electrodes 12A and 12B consist of the scan electrode 12A and the sustain electrode 12B. The scan electrode 12A mainly supplies a scan signal for an address discharge and a sustain signal for a sustain discharge. The sustain electrode 12B mainly supplies a sustain signal, while operating in turn with the scan electrode 12A. The data electrodes 20 is formed to intersect the pair of the sustain electrodes 12A and 12B and supplies a data signal for the address discharge.

An upper dielectric layer 14 and a protection film 16 are laminated on the upper substrate 10 on which the pair of the sustain electrodes 12A and 12B are formed. A lower dielectric layer 22 is formed on the lower substrate 18 having the data electrodes 20 formed thereon. The upper dielectric layer 14 and the lower dielectric layer 22 serve to accumulate electric charges generated by a discharge. The protection film 16 serves to prevent the upper dielectric layer 14 from being damaged due to sputtering of plasma particles and increase efficiency of secondary electron emission, upon discharge. These dielectric layers 14 and 22 and the protection film 16 cause a driving voltage supplied from the outside to be lowered.

Barrier ribs 24 are formed at the lower substrate 18 on which the lower dielectric layer 22 is formed. A phosphor layer 26 is formed on the surfaces of the lower dielectric layer 22 and the barrier ribs 24. The barrier ribs 24 serve to separate discharge spaces and to prevent the ultraviolet rays generated by a gas discharge from leaking toward neighboring discharge spaces. The phosphor layer 26 is light-emitted by the ultraviolet rays generated by the gas discharge, producing a red (hereinafter, referred to as as "B") visible rays. Furthermore, the discharge spaces are filled with insert gases for the gas discharge.

This discharge cell is selected by an address discharge due to the data electrodes 20 and the scan electrode 12A, and the selected discharge cell maintains its discharge by means of a sustain discharge due to the pair of the sustain electrodes 12A and 12B. Also, the discharge cell enables the phosphor to emit light by means of the ultraviolet rays generated during the sustain discharge, thus producing the R, G or B visible ray. In this case, the discharge cell implements a gray scale that is necessary to display an image by controlling a sustain discharge period, i.e., the number of a sustain discharge depending on the video data. Moreover, three discharge cells on which the R, G and B phosphors are covered are combined to implement color of one pixel.

FIG. 2 shows the configuration of sub-fields included in one frame. A typical method for driving this PDP is an ADS (Address and Display Separation) driving method wherein driving is performed with a period divided into an address period and a display period, i.e., a sustain period separately. In the ADS driving method, one frame 1F is divided into a plurality of sub-fields SF1 to SF8 corresponding to respective bits of the video data, as shown in FIG. 2. Each of the sub-fields SF1 to SF8 is then divided into a reset period RPD for initializing a discharge cell, an address period APD for selecting a discharge cell, and a sustain period SPD for maintaining discharge of the selected discharge cell. In the above, different numbers of sustain pulses by the sub-fields SF1 to SF8 are assigned to the sustain period SPD, and the sustain period SPD is assembled according to the video data, whereby the PDP implements a corresponding gray scale.

FIG. 3 shows a driving waveform in a conventional plasma display panel.

Referring to FIG. 3, each of the first and second sub-fields SF1 and SF2 includes a reset period RPD for initializing discharge cells, an address period APD for selecting discharge cells, a sustain period SPD for maintaining discharge of the selected discharge cell, and an erasing period EPD for discharge erasing.

FIG. 4 shows a process in which wall charges are changed in a reset period. The reset period RDP includes a set-up period SUPD for forming wall charges in all the discharge cells, and a set-down period SDPD for erasing unnecessary wall charges from the discharge cells. In the set-up period SUPD, a ramp-up pulse RUP where a voltage slowly rises from a sustain voltage Vs to the peak voltage Vp is supplied to the scan electrodes Y. A reset discharge occurs in all the discharge cells by means of the ramp-up pulse RUP. Accordingly, wall charges of the negative polarity are formed on the side of the scan electrodes Y and wall charges of the positive polarity are formed on the side of the sustain electrodes Z and the data electrodes X, as shown in FIG. 4.

Thereafter, in the set-down period SDPD, a ramp-down pulse RDP where a voltage of the scan electrodes Y drops from the peak voltage Vp to the sustain voltage Vs and a voltage slowly drops from the sustain voltage Vs to the ground voltage is supplied. Since a weak erasing discharge occurs in all the discharge cells by means of the ramp-down pulse RDP, unnecessary wall charges are erased and wall charges required in a subsequent address discharge remain, as shown in FIG. 4.

Meanwhile, in the set-up period SUPD, the ground voltage is applied to the sustain electrodes Z and the data electrodes X. In the set-down period SDPD, a DC bias voltage BP of the positive polarity is applied to the sustain electrodes Z and the ground voltage is applied to the data electrodes X.

In the address period APD, the scan pulse SP of the negative polarity is sequentially applied to the scan electrodes Y and the data pulse DP of the positive polarity is applied to the data electrodes X in synchronism with the scan pulse SP. Accordingly, in a corresponding discharge cell, a voltage difference between the scan pulse SP and the data pulse DP and a wall voltage by means of the wall charges generated in the reset period RPD are added. Thus an address discharge occurs. By means of this address discharge, wall charges to be used in a subsequent sustain discharge are formed within the corresponding discharge cell. In this address period APD, the DC bias voltage BP is supplied to the sustain electrodes Z.

In the sustain period SPD, sustain pulses SUSPy and SUSPz are alternately applied to the scan electrodes Y and the sustain electrodes Z. Therefore, in the discharge cells in which the wall charges are formed by the address discharge, the wall voltage and each voltage of the sustain pulses SUSPy and SUSPz are added. Thus, whenever the sustain pulses SUSPy and SUSPz are applied, the sustain discharge occurs. By means of this sustain discharge, a corresponding discharge cell emits a visible ray proportional to the sustain period SPD.

In the erasing period EPD, the erase pulse SP is applied to the sustain electrodes Z and an erasing discharge thus occurs. Therefore, wall charges within the discharge cell are erased.

As such, in the conventional method for driving the PDP, the reset period RPD is required every sub-field in order to form wall charges to be used in the address period APD. In the reset period RPD, however, unnecessary light is generated due to the reset discharge generated in all the discharge cells. Therefore, there is a problem that contrast is degraded.

In the concrete, during the set-up period SUPD of the reset period RPD, the reset discharge occurs between the scan electrodes Y and the sustain electrodes Z and between the scan electrodes Y and the data electrodes X by means of the ramp-up pulse RUP supplied to the scan electrodes Y. Discharge that degrades contrast in this reset discharge is a surface discharge between the scan electrodes Y and the sustain electrodes Z. This is because light generated by the surface discharge between the scan electrodes Y and the sustain electrodes Z is generated in the whole area of the discharge cell. Therefore, in order to reduce unnecessary light occurring in the set-up period SUPD, it is required that the discharge between the scan electrodes Y and the sustain electrodes Z be small and short.

SUMMARY OF THE INVENTION

Accordingly, an object of the present invention is to solve at least the problems and disadvantages of the background art.

An object of the present invention is to provide a method for resetting a PDP which can improve contract by reducing unnecessary light in a set-up period, and apparatus thereof.

According to an embodiment of the present invention, a method for resetting a plasma display panel having scan electrodes and sustain electrodes, wherein discharge cells of the plasma display panel are initialized in a plurality of sub-fields, respectively, the method comprises the steps of: forming initial wall charges in the discharge cells by means of a reset discharge in a set-up period; and erasing unnecessary wall charges of the initial wall charges from the discharge cells by means of an erasing discharge in a set-down period, wherein a period where the sustain electrodes are floated during the set-up period is set in one or more sub-fields.

According to an embodiment of the present invention, an apparatus for resetting a plasma display panel having scan electrodes and sustain electrodes, wherein discharge cells of the plasma display panel are initialized in a plurality of sub-fields, respectively, the apparatus comprises: sustain electrodes driving circuit that supplies a first voltage to the sustain electrodes in a set-up period where initial wall charges are formed in the discharge cells by means of a reset discharge, that floats the sustain electrodes as long as a given period in one or more sub-fields in the second half of the set-up period, and that supplies a second voltage higher than the first voltage to the sustain electrodes in a set-down period where unnecessary wall charges of the initial wall charges are erased from the discharge cells by means of an erasing discharge.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
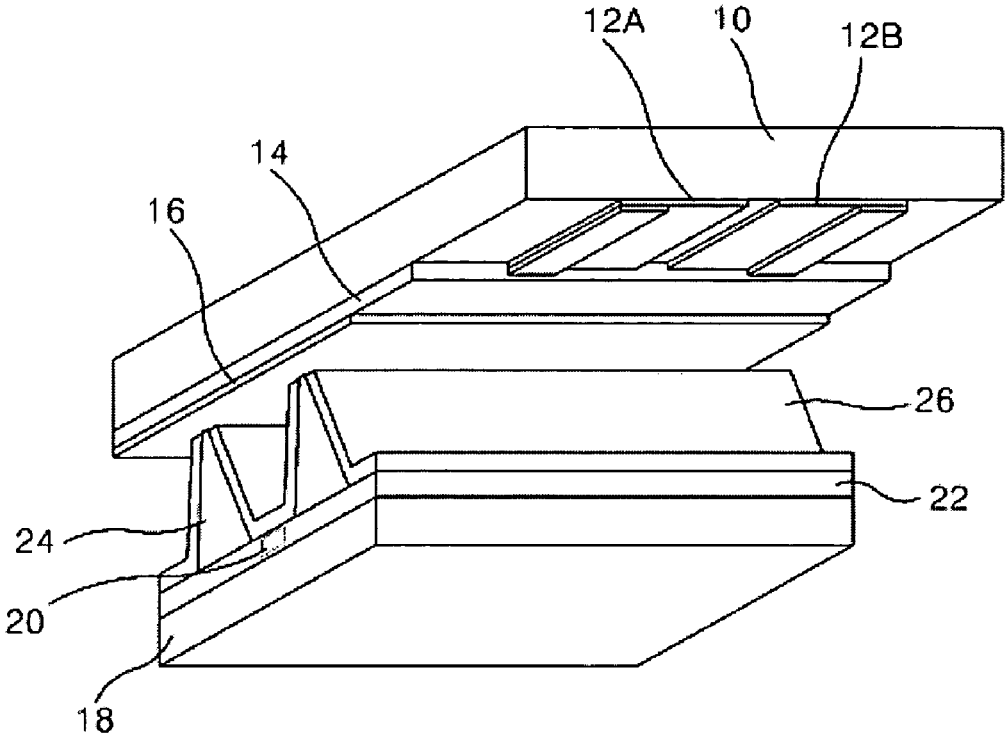
FIG. 1 is a perspective view showing the structure of a discharge cell in a conventional plasma display panel.
Figure 2:
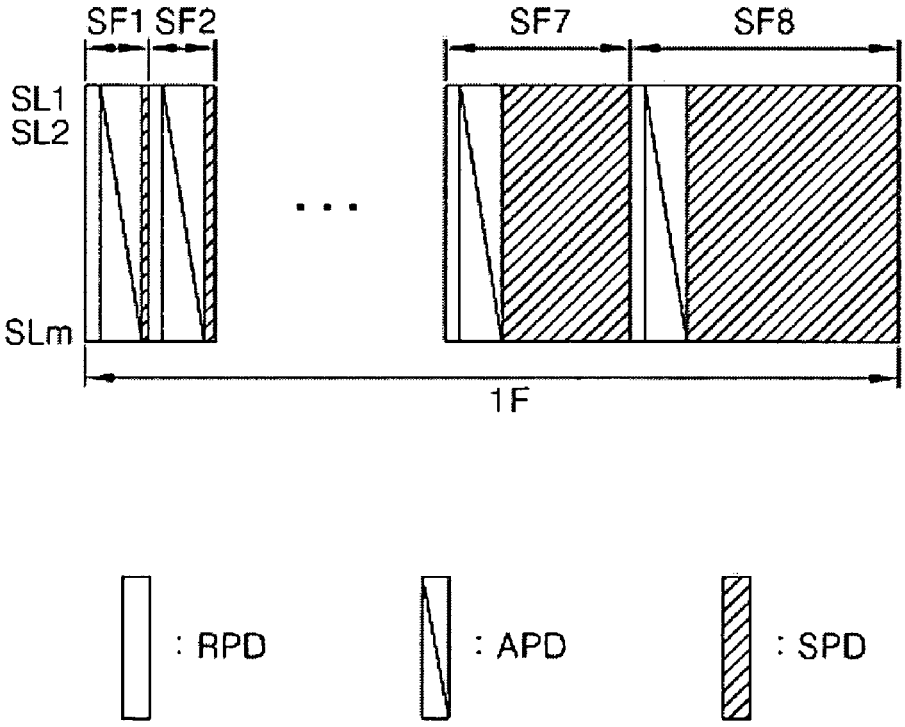
FIG. 2 shows the configuration of sub-fields included in one frame.
Figure 3:
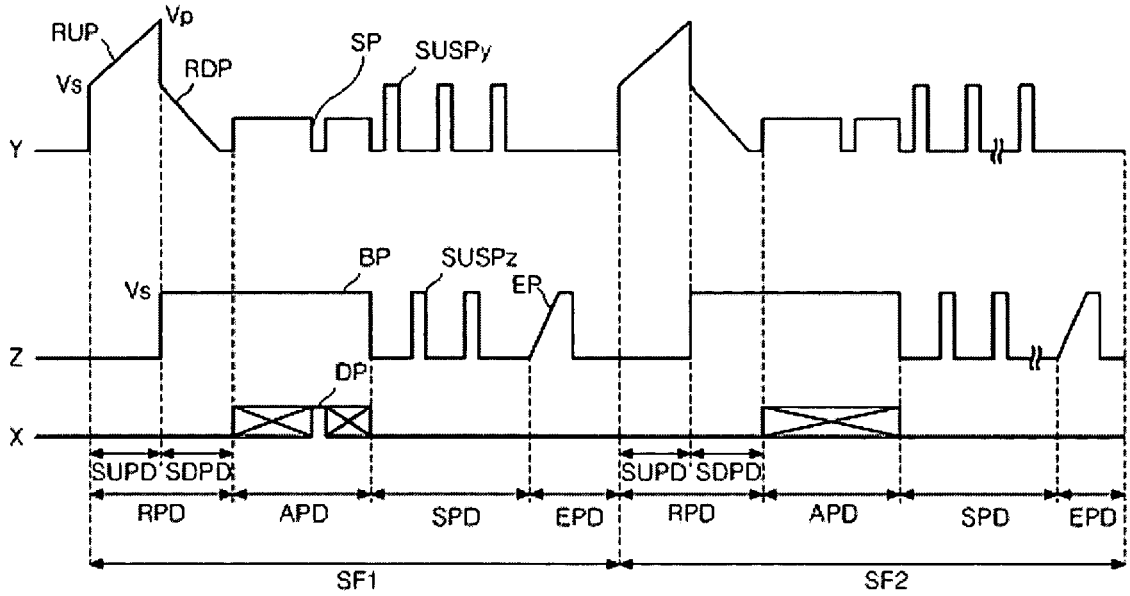
FIG. 3 shows a driving waveform in a conventional plasma display panel.
Figure 4:
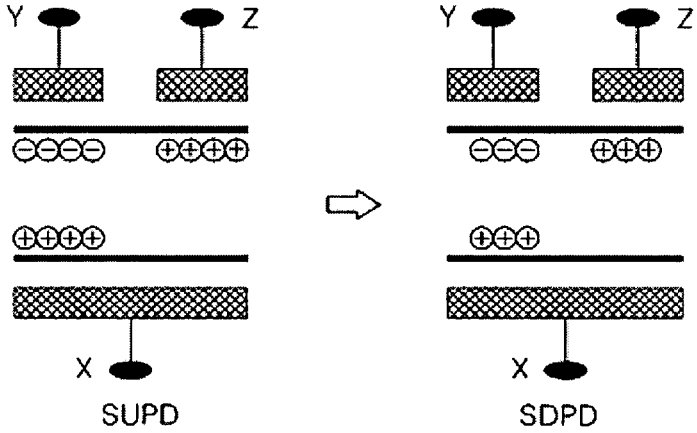
FIG. 4 shows a process in which wall charges are changed in a reset period.

According to an embodiment of the present invention, a method for resetting a plasma display panel having scan electrodes and sustain electrodes, wherein discharge cells of the plasma display panel are initialized in a plurality of sub-fields, respectively, the method comprises the steps of: forming initial wall charges in the discharge cells by means of a reset discharge in a set-up period; and erasing unnecessary wall charges of the initial wall charges from the discharge cells by means of an erasing discharge in a set-down period, wherein a period where the sustain electrodes are floated during the set-up period is set in one or more sub-fields.

The period where the sustain electrodes are floated during the set-up period is differently set in each of the plurality of the sub-fields.

In the second half of the set-up period, the sustain electrodes are floated to stop the reset discharge.

In the floating period, a voltage of the sustain electrodes varies depending on a voltage applied to the scan electrodes for the reset discharge.

The floating period of the sustain electrodes are set to be increased as it goes from a low gray scale sub-field to a high gray scale sub-field.

The floating period of the sustain electrodes are set to be reduced as it goes from a low gray scale sub-field to a high gray scale sub-field.

The plurality of the sub-fields are divided into a plurality of blocks according to a brightness weighted value and the floating period of the sustain electrodes are differently set in the every sub-field block.

The floating period of the sustain electrodes is set to be relatively long in at least one sub-field corresponding to a low gray scale among the plurality of the sub-fields, and is set to be same in the remaining sub-fields.

According to an embodiment of the present invention, an apparatus for resetting a plasma display panel having scan electrodes and sustain electrodes, wherein discharge cells of the plasma display panel are initialized in a plurality of sub-fields, respectively, the apparatus comprises: sustain electrodes driving circuit that supplies a first voltage to the sustain electrodes in a set-up period where initial wall charges are formed in the discharge cells by means of a reset discharge, that floats the sustain electrodes as long as a given period in one or more sub-fields in the second half of the set-up period, and that supplies a second voltage higher than the first voltage to the sustain electrodes in a set-down period where unnecessary wall charges of the initial wall charges are erased from the discharge cells by means of an erasing discharge.

The sustain electrodes driving circuit is differently set in each of the plurality of sub-fields.

The sustain electrodes driving circuit sets the floating period of the sustain electrodes to be increased as it goes from a low gray scale sub-field to a high gray scale sub-field.

The sustain electrodes driving circuit sets the floating period of the sustain electrodes to be reduced as it goes from a low gray scale sub-field to a high gray scale sub-field.

The sustain electrodes driving circuit sets differently the floating period of the sustain electrodes in each of the sub-field blocks divided into a plurality of blocks according to a brightness weighted value.

The sustain electrodes driving circuit sets the floating period of the sustain electrodes to be relatively long in at least one sub-field corresponding to a low gray scale among the plurality of the sub-fields and sets the floating period to be same in the remaining sub-fields.

Preferred embodiments of the present invention will be described in a more detailed manner with reference to the accompanying FIG. 5 to FIG. 6.

Figure 5:
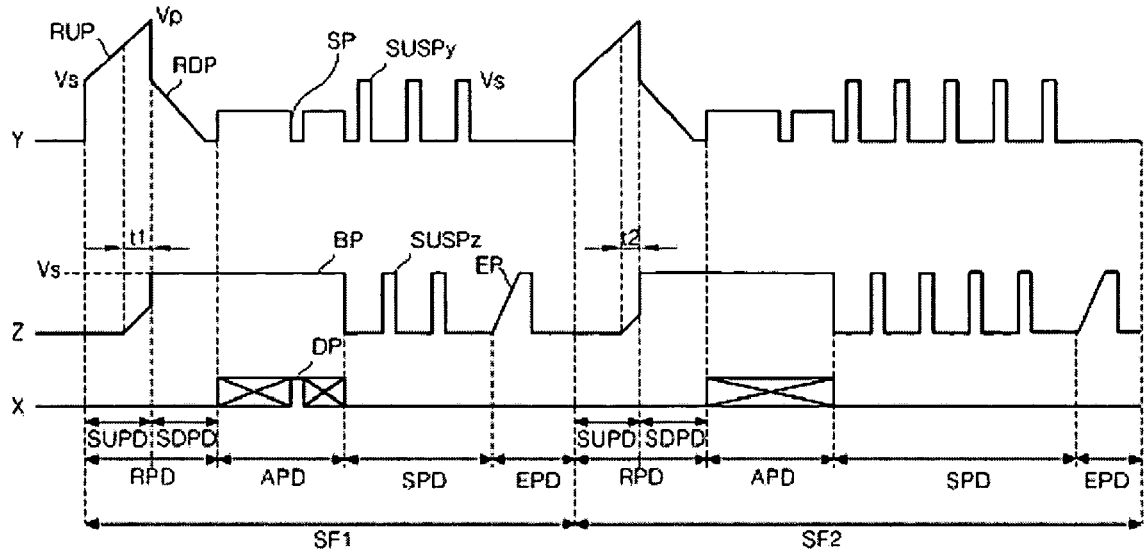
FIG. 5 shows a driving waveform shown to explain a method for resetting a plasma display pane according to an embodiment of the present invention a method.

FIG. 5 shows a driving waveform shown to explain a method for resetting a plasma display pane according to an embodiment of the present invention a method.

Referring to FIG. 5, each of sub-fields SF1 and SF2 includes a reset period RPD for initializing discharge cells, an address period APD for selecting discharge cells, a sustain period SPD for maintaining discharge of the selected discharge cell, and an erasing period EPD for discharge erasing.

The reset period RDP includes a set-up period SUPD for forming wall charges in all the discharge cells, and a set-down period SDPD for erasing unnecessary wall charges from the discharge cells. In the set-up period SUPD, a ramp-up pulse RUP where a voltage slowly rises from a sustain voltage Vs to the peak voltage Vp is supplied to scan electrodes Y. A reset discharge occurs in all the discharge cells by means of the ramp-up pulse RUP and wall charges are thus formed on all the discharge cells.

In the above, in order to reduce the amount and period of the reset discharge, the sustain electrodes Z, to which the ground voltage is supplied in the first half of the set-up period SUPD, is floated in the second half of the set-up period SUPD. At this time, a method for making the sustain electrodes Z floating will be described later. If the sustain electrodes Z is in a floating state, i.e., no voltage is applied to the sustain electrodes Z, a surface discharge between the scan electrodes Y and the sustain electrodes Z is also stopped. In other words, if the sustain electrodes Z is floated, the voltage on the sustain electrodes Z is influenced by the scan electrodes Y and thus rises slowly according to the ramp-up pulse RUP supplied from the scan electrodes Y. At this time, since the amount of an increase in the voltage of the sustain electrodes Z and the amount of an increase in the voltage of the scan electrodes Y are the same, the surface discharge is stopped between the scan electrodes Y and the sustain electrodes Z of the floating state. Accordingly, since the amount and period of the reset discharge are reduced, unnecessary light occurring in the set-up period SUPD can be reduced.

Thereafter, in the set-down period SDPD, a ramp-down pulse RDP where a voltage of the scan electrodes Y drops from the peak voltage Vp to the sustain voltage Vs and a voltage slowly drops from the sustain voltage. Vs to the ground voltage is supplied to the scan electrodes Y. Since a weak erasing discharge occurs in all the discharge cells by means of the ramp-down pulse RDP, unnecessary wall charges are erased and wall charges required in a subsequent address discharge remain. Meanwhile, in the set-down period SDPD, a DC bias voltage BP of the positive polarity is applied to the sustain electrodes Z and the ground voltage is applied to the data electrodes X.

In the address period APD, the scan pulse SP of the negative polarity is sequentially applied to the scan electrodes Y and the data pulse DP of the positive polarity is applied to the data electrodes X in synchronism with the scan pulse SP. Accordingly, in a corresponding discharge cell, a voltage difference between the scan pulse SP and the data pulse DP and a wall voltage by means of the wall charges generated in the reset period RPD are added, so that an address discharge occurs. By means of this address discharge, wall charges to be used in a subsequent sustain discharge are formed in the corresponding discharge cell. Meanwhile, in the address period APD, the DC bias voltage BP is supplied to the sustain electrodes Z.

In the sustain period SPD, sustain pulses SUSPy and SUSPz are alternately applied to the scan electrodes Y and the sustain electrodes Z. Therefore, in the discharge cells in which the wall charges are formed by the address discharge, the wall voltage and a voltage of each of the sustain pulses SUSPy and SUSPz are added. Thus, whenever the sustain pulses SUSPy and SUSPz are applied, the sustain discharge occurs. Due to this sustain discharge, a corresponding discharge cell emits a visible ray proportional to the sustain period SPD.

In the erasing period EPD, since the erase pulse SP is applied to the sustain electrodes Z, an erasing discharge occurs. Therefore, wall charges within the discharge cell are erased.

These reset period RPD, address period APD, sustain period SPD and erasing period EPD are repeated every sub-fields. In the above, the sustain period SPD is set to have a different weighted value in every sub-field.

More particularly, in the method for driving the PDP according to the present invention, in order to reduce unnecessary light in the set-up period SUPD, the period where the sustain electrodes Z is floated is differently set every sub-field. The reason for this is because distribution of wall charges after each sustain period SPD is different in every sub-field since each of the sub-fields has a different sustain period SPD. Therefore, it is more effective that a reset condition is differently set depending on each sub-field rather than generating the same reset discharge in all the sub-fields. For example, if the floating period of the sustain electrodes Z is set to t1 in the sub-field SF1 corresponding to lower bits among video data, i.e., a low gray scale, the floating period of the sustain electrodes Z is set to t2 lower than t1 in the sub-field SF2 corresponding to upper bits, i.e., a high gray scale. The reason for this is because the low gray scale sub-field SF1 whose number of the sustain discharge is small is less affected by the sustain discharge than the high gray scale sub-field SF2 whose number of the sustain discharge is great. Accordingly, the period t1 where the sustain electrodes Z is floated in the set-up period SUPD of the low gray scale sub-field SF1 may be longer than the period t2 where the sustain electrodes Z is floated in the set-up period SUPD of the high gray scale sub-field SF2. Therefore, the amount and period of the reset discharge in the low gray scale sub-field SF1 become smaller than those in the high gray scale sub-field SF2. Resultantly, since unnecessary light at the low gray scale that becomes the main cause of a reduction in contrast is reduced, contrast can be further improved.

Meanwhile, the floating period of the sustain electrodes Z in the second half of the set-up period SUPD can be set so that it gradually rises or reduces from the high gray scale sub-field toward the low gray scale sub-field. On the contrary, the floating period of the sustain electrodes Z in the second half of the set-up period SUPD can be set so that it is relatively long only in one sub-field corresponding to the most significant bit or two sub-fields corresponding to the lower bits, and can be set same in the remaining sub-fields. Moreover, after the sub-fields constituting one frame are divided into a plurality of blocks depending on a brightness weighted value, they can be set so that the floating period of the sustain electrodes Z is different every block. In this case, each of the sub-field blocks is set to include at least two sub-fields having a neighboring brightness weighted value.

Figure 6:
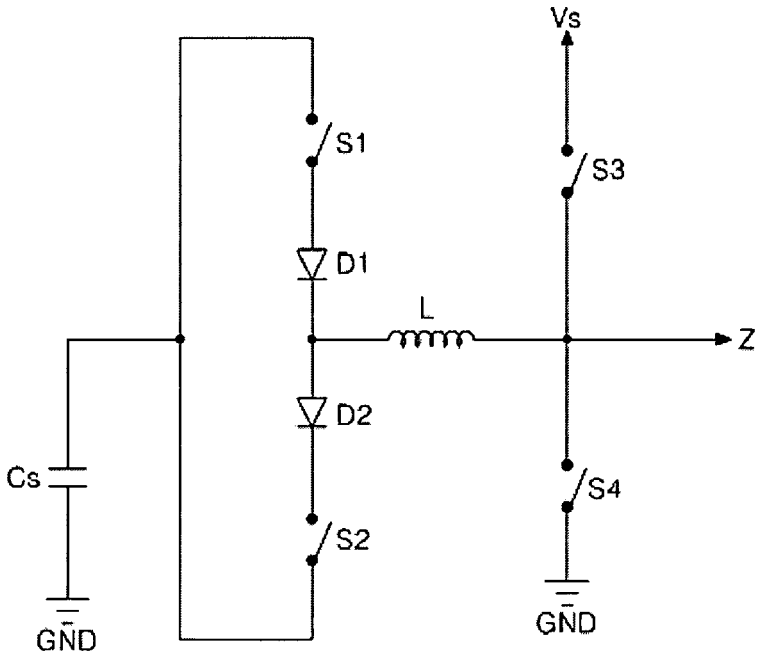
FIG. 6 is a detailed circuit diagram showing a sustain driving circuit for supplying a driving waveform to sustain electrodes shown in FIG. 5.

FIG. 6 is a detailed circuit diagram showing a sustain driving circuit for supplying a driving waveform to the sustain electrodes shown in FIG. 5.

The sustain driving circuit shown in FIG. 6 includes a source capacitor Cs for charging a voltage recovered from a PDP through the sustain electrodes Z, an inductor L serially connected to the sustain electrodes Z, a first switch S1 and a first diode D1 that form a charging path between the source capacitor Cs and the inductor L, a second switch S2 and a second diode D2 that form a discharging path between the source capacitor Cs and the inductor L, a third switch S3 connected between the supply line of the sustain voltage Vs and the sustain electrodes Z, and a fourth switch S4 connected between the supply line of the ground voltage GND and the sustain electrodes Z.

As the fourth switch S4 is turned on according to a control signal in the set-up period SUPD of the reset period RPD shown in FIG. 5, the ground voltage GND from the supply line of the ground voltage GND is applied to the sustain electrodes Z. At this time, the first to third switches S1 to S3 are turned off.

Furthermore, as the fourth switch S4 is turned off according to the control signal in the second half of the set-up period SUPD, no voltage is supplied to the sustain electrodes Z and the sustain electrodes Z is floated. The potential of the sustain electrodes Z that is floated is affected by the scan electrodes Y and thus slowly rises according to the ramp-up pulse RUP. At this time, the amount of the increased voltage applied to the scan electrodes Y and the amount of the increased voltage applied to the sustain electrodes Z become identical.

Since the sustain electrodes Z is floated as such, the reset discharge occurring between the scan electrodes Y and the sustain electrodes Z by the ramp-up pulse RUP is stopped.

Next, since the third switch S3 is turned on according to the control signal in the set-down period SDPD, the sustain voltage Vs from the supply line of the sustain voltage Vs is supplied to the sustain electrodes Z as a DC bias voltage BP. Also, as the third switch S3 keeps turned on even in the address period APD, the sustain electrodes Z continues to receive the sustain voltage Vs as the DC bias voltage BP.

Furthermore, the sustain driving circuit supplies the sustain pulse SUSPz to the sustain electrodes Z in the sustain period SPD by means of an energy recovery method.

As described above, in a method for setting a PDP and apparatus thereof according to the present invention, a period where sustain electrodes is floated is differently set in every sub-field in the second half of a set-up period. It is thus possible to further reduce unnecessary light in a low gray scale sub-field and thus improve contrast.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for resetting a plasma display panel having scan electrodes and sustain electrodes, wherein discharge cells of the plasma display panel are initialized in a plurality of sub-fields, respectively, the method comprising:

forming initial wall charges in the discharge cells based on a reset discharge in a set-up period; and erasing unnecessary wall charges of the initial wall charges from the discharge cells based on an erasing discharge in a set-down period, wherein the set-up period and set-down period are in a reset period that occurs before an address period and wherein a period where the sustain electrodes are floated during the set-up period is set in one or more sub-fields.

2. The method of claim 1, wherein the period where the sustain electrodes are floated during the set-up period is differently set in each of the plurality of the sub-fields.

3. The method of claim 2, wherein the floating period of the sustain electrodes is set to be relatively long in at least one sub-field corresponding to a low gray scale among the plurality of the sub-fields, and is set to be same in the remaining sub-fields.

4. The method of claim 1, wherein in the second half of the set-up period, the sustain electrodes are floated to stop the reset discharge.

5. The method of claim 1, wherein in the floating period, a voltage of the sustain electrodes varies depending on a voltage applied to the scan electrodes for the reset discharge.

6. The method of claim 1, wherein the floating period of the sustain electrodes are set to be increased as it goes from a low gray scale sub-field to a high gray scale sub-field.

7. The method of claim 1, wherein the floating period of the sustain electrodes are set to be reduced as it goes from a low gray scale sub-field to a high gray scale sub-field.

8. The method of claim 1, wherein the plurality of the sub-fields are divided into a plurality of blocks according to a brightness weighted value and the floating period of the sustain electrodes are differently set in the every sub-field block.

9. An apparatus for resetting a plasma display panel having scan electrodes and sustain electrodes, wherein discharge cells of the plasma display panel are initialized in a plurality of sub-fields, respectively, the apparatus comprising:

sustain electrodes driving circuit that supplies a first voltage to the sustain electrodes in a set-up period where initial wall charges are formed in the discharge cells by means of a reset discharge, that floats the sustain electrodes as long as a given period in one or more sub-fields in the second half of the set-up period, and that supplies a second voltage higher than the first voltage to the sustain electrodes in a set-down period where unnecessary wall charges of the initial wall charges are erased from the discharge cells by means of an erasing discharge.

10. The apparatus of claim 9, wherein the sustain electrodes driving circuit is differently set in each of the plurality of sub-fields.

11. The apparatus of claim 9, wherein the sustain electrodes driving circuit sets the floating period of the sustain electrodes to be increased as it goes from a low gray scale sub-field to a high gray scale sub-field.

12. The apparatus of claim 9, wherein the sustain electrodes driving circuit sets the floating period of the sustain electrodes to be reduced as it goes from a low gray scale sub-field to a high gray scale sub-field.

13. The apparatus of claim 9, wherein the sustain electrodes driving circuit sets differently the floating period of the sustain electrodes in each of the sub-field blocks divided into a plurality of blocks according to a brightness weighted value.

14. The apparatus of claim 9, wherein the sustain electrodes driving circuit sets the floating period of the sustain electrodes to be relatively long in at least one sub-field corresponding to a low gray scale among the plurality of the sub-fields and sets the floating period to be same in the remaining sub-fields.

15. A method for controlling a plasma display panel, comprising:

forming wall charges in a discharge cell during a set-up period of a reset period; and applying a voltage to at least one of a sustain electrode, scan electrode, or data electrode of the discharge cell to generate light for forming an image for display, wherein the reset period occurs before an address period and wherein the sustain electrode is floated for a first amount of time during the set-up period of the reset period.

16. The method of claim 15, wherein the sustain electrode is set to a first potential during a second amount of time during the set-up period of the reset period, the second amount of time arranged before the first amount of time.

17. The method of claim 16, wherein the first potential is lower than floating voltages assumed by the sustain electrode during the first amount of time.

18. The method of claim 15, further comprising:

applying a changing voltage to the scan electrode during the set-up period of the reset period, the sustain electrode assuming a floating voltage that changes proportionally with the voltage applied to the scan electrode during the first amount of time.

19. The method of claim 18, wherein the voltage applied to the scan electrode and the floating voltage of the sustain electrode change at substantially a same rate.

20. The method of claim 15, wherein the first amount of time is less than the entire set-up period.

21. The method of claim 15, wherein the sustain electrode assumes a floating voltage for the first amount of time during the set-up period, the floating voltage controlled by a voltage applied to the scan electrode during the set-up period.

22. The method of claim 15, wherein the sustain electrode is floated for a first amount of time during the set-up period of the reset period that corresponds to a first sub-field, wherein the sustain electrode is floated for a second amount of time during a set-up period of a reset period that corresponds to a second sub-field, and wherein the first amount of time is different from the second amount of time.

23. The method of claim 22, wherein the sub-fields are adjacent sub-fields.

24. The method of claim 22, wherein the first amount of time is greater than the second amount of time.

* * * * *